US011174086B2

(12) United States Patent
Huang

(10) Patent No.: US 11,174,086 B2
(45) Date of Patent: Nov. 16, 2021

(54) PAPER CONTAINER FOR COSMETIC PRODUCTS

(71) Applicant: Wei Chin Huang, Zhuahai (CN)

(72) Inventor: Wei Chin Huang, Zhuahai (CN)

(73) Assignee: SHEENCOL'OR BIOTECH CO., LTD., Zhuahai (CN)

( * ) Notice: Subject to any disclaimer, the term of this patent is extended or adjusted under 35 U.S.C. 154(b) by 157 days.

(21) Appl. No.: 16/571,272

(22) Filed: Sep. 16, 2019

(65) Prior Publication Data

US 2021/0078784 A1 Mar. 18, 2021

(51) Int. Cl.
*B65D 77/04* (2006.01)
*A45D 33/00* (2006.01)

(52) U.S. Cl.
CPC ..... *B65D 77/0413* (2013.01); *A45D 33/00* (2013.01)

(58) Field of Classification Search
CPC ..... A45D 19/06; A45D 33/00; A45D 40/22; A45D 40/24; A45D 33/24; A45D 33/26; B65D 5/50; B65D 5/66; B65D 21/02; B65D 51/24; B65D 51/28; B65D 77/04; B65D 77/0413; B65D 81/32; B65D 85/42
USPC ..... 132/293–307, 314–315, 317–318; 206/486, 581, 804, 815
See application file for complete search history.

(56) References Cited

U.S. PATENT DOCUMENTS

| | | | | |
|---|---|---|---|---|
| 1,323,170 | A * | 11/1919 | Dodge | B65D 5/6661 229/149 |
| 3,489,313 | A * | 1/1970 | Haugen | B65D 43/162 206/454 |
| 5,096,055 | A * | 3/1992 | Opper | B65D 5/5213 206/804 |
| 5,980,960 | A * | 11/1999 | Amitai | A45D 40/0087 132/320 |
| 9,480,322 | B2 * | 11/2016 | Mortis Simons | A45D 33/008 |
| 10,266,320 | B2 * | 4/2019 | McKenzie | B65D 81/32 |
| 10,882,661 | B1 * | 1/2021 | Seidler | B65D 21/083 |
| 2005/0173291 | A1 * | 8/2005 | Specker | B65D 77/046 206/536 |
| 2019/0144178 | A1 * | 5/2019 | McKenzie | A45D 40/0068 132/294 |

FOREIGN PATENT DOCUMENTS

WO WO-8807825 A1 * 10/1988 ..... A45D 40/22

* cited by examiner

*Primary Examiner* — Bryon P Gehman

(57) ABSTRACT

A paper container for cosmetic products is provided with a casing made of cardboard and including a cover, a base, and an intermediate section hingedly interconnected to the cover and the base; a flap made of paper and being partially attached to an inner surface of the cover; a receiving member made of cardboard attached to a top of the base and including at least one receptacle and a groove on a front end of a bottom wherein the flap is configured to insert into the groove; and a through hole disposed through the base and the receptacle.

5 Claims, 6 Drawing Sheets

PAPER CONTAINER FOR COSMETIC PRODUCTS

BACKGROUND OF THE INVENTION

1. Field of the Invention

The invention relates cosmetic containers and more particularly to a paper container for cosmetic products by providing a through hole through a base so that a cosmetic box may be releasably disposed in the receptacle, and the paper container being adapted to reuse or recycle for environmental protection purposes.

2. Description of Related Art

For decreasing pollution to the environment, some manufactures have change the material of making cosmetic containers from plastic to paper. In a conventional paper container for cosmetic products, a magnet is provided on each of a cover and a receptacle. Thus, the container can be securely closed due to magnetic attraction when one magnet is attached to the other magnet.

However, the container is provided with the magnets which are required to be classified when the container is recycled. This is no good to environmental protection.

Thus, the need for improvement still exists.

SUMMARY OF THE INVENTION

It is therefore one object of the invention to provide a paper container for cosmetic products comprising a casing made of cardboard and including a cover, a base, and an intermediate section hingedly interconnected to the cover and the base; a flap made of paper and being partially attached to an inner surface of the cover; a receiving member made of cardboard attached to a top of the base and including at least one receptacle and a groove on a front end of a bottom wherein the flap is configured to insert into the groove; and a through hole disposed through the base and the receptacle.

The invention has the following advantages and benefits in comparison with the conventional art:

It is recyclable due to its paper material.

After inserting a hinged front portion of the flap into the groove of the receiving member, an intermediate portion of the flap engages a front end of the receiving member and a hinged tab of the flap urges against a top of a front end of the base of the casing, thereby securely closing the receiving member. Therefore, closing of the paper container is made easy. Further, opening of the closed paper container is made easy by pulling the hinged tab of the flap.

A cosmetic box can be releasably disposed in the receptacle. An individual may insert his or her finger through the through hole to push the cosmetic box out of the receptacle for use. After use, the individual may place another cosmetic box in the receptacle again. The cosmetic container can be reused or recycled for environmental protection purposes.

The above and other objects, features and advantages of the invention will become apparent from the following detailed description taken with the accompanying drawings.

DETAILED DESCRIPTION OF THE INVENTION

Figure 1:
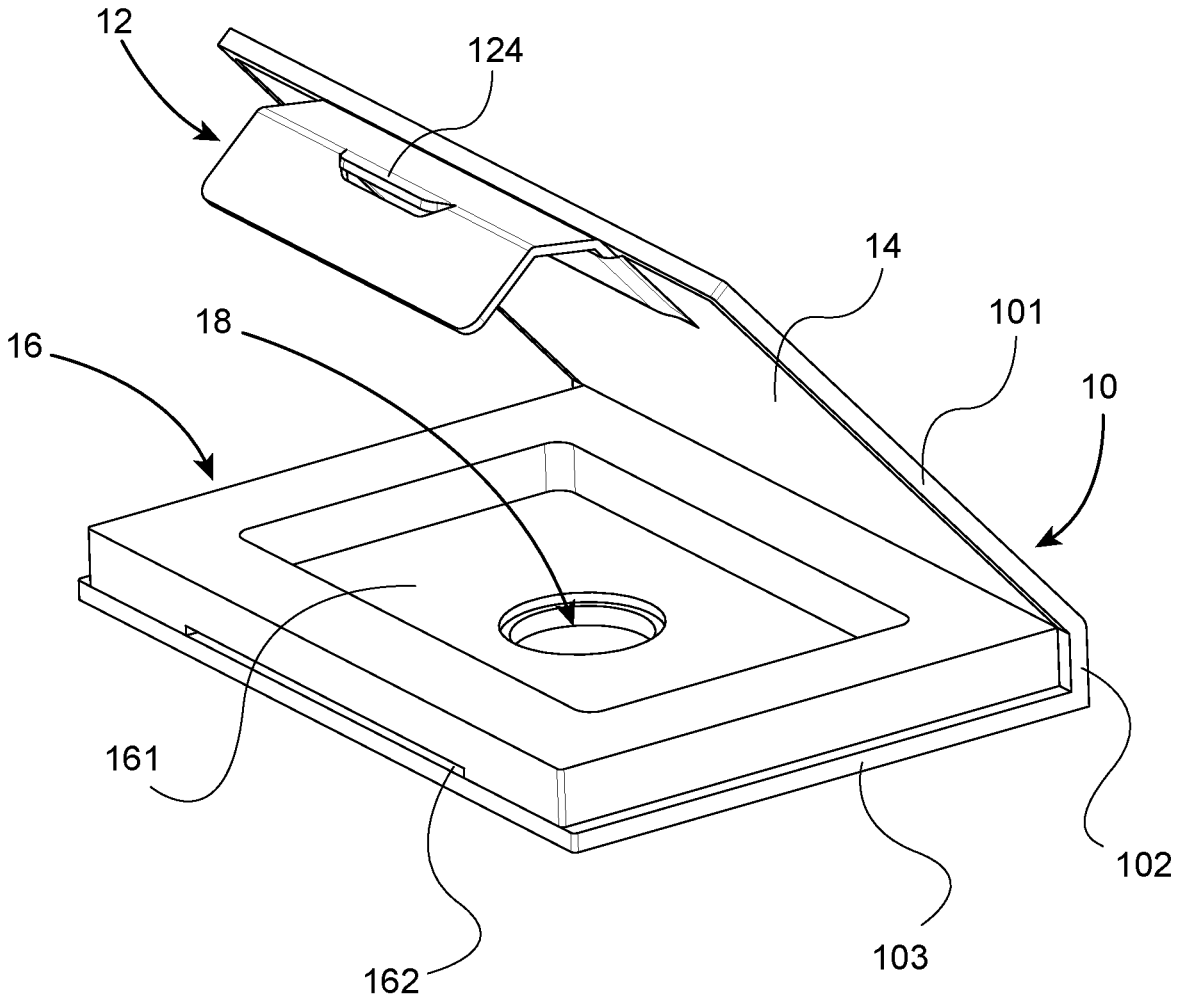
FIG. 1 is a perspective view of a paper container for cosmetic products according to a first preferred embodiment of the invention, the paper container being open.
Figure 2:
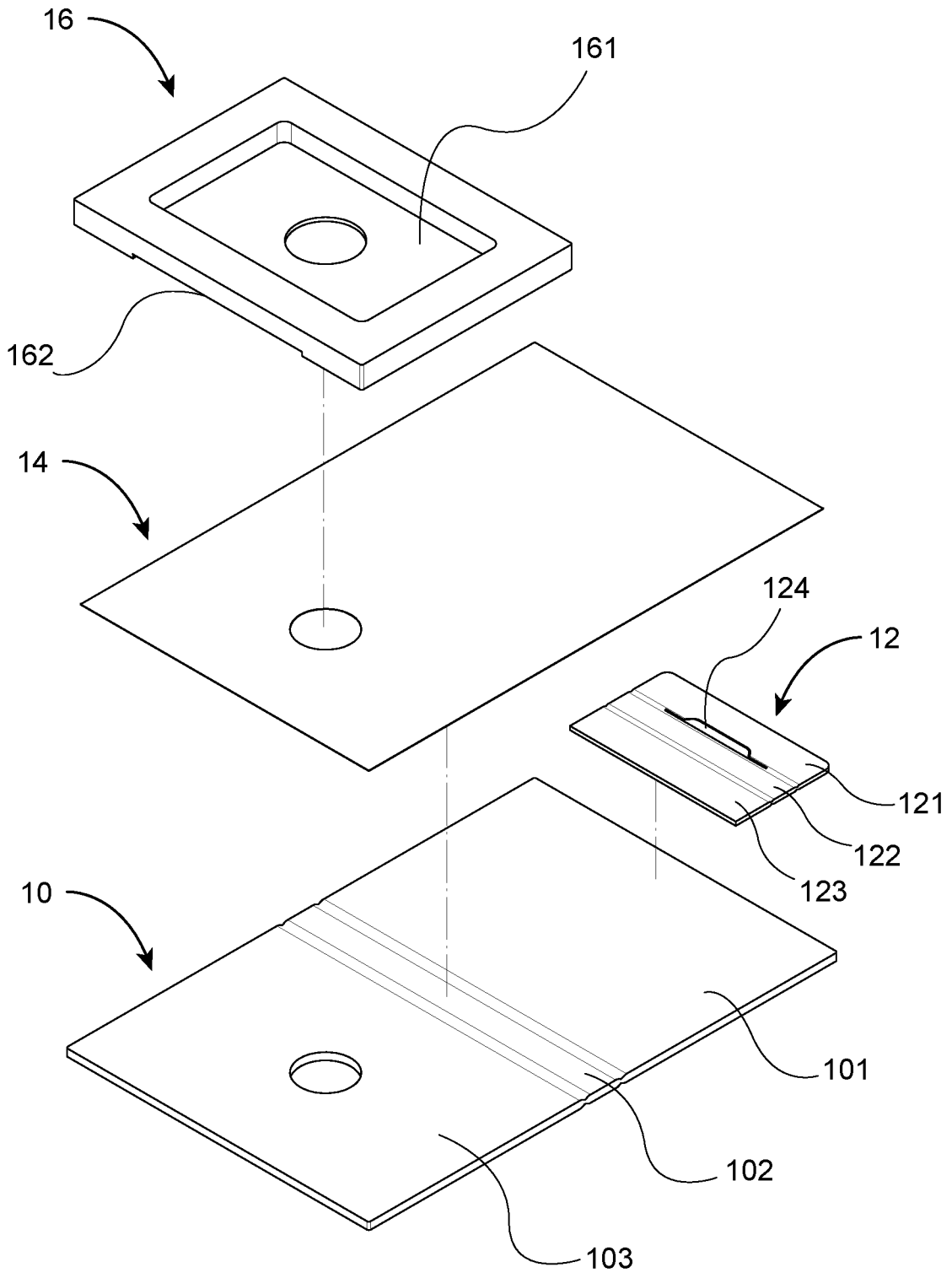
FIG. 2 is an exploded view of the paper container.

Referring to FIGS. 1 and 2, a paper container for cosmetic products (hereinafter "cosmetic container") in accordance with a first preferred embodiment of the invention comprises a casing 10 made of cardboard and including a cover 101, a base 103, and an intermediate section 102 hingedly interconnected to the cover 101 and the base 103; a flap 12 made of paper and being partially attached to an inner surface of the cover 101; a sheet of paper 14 attached to an inner surface of the casing 10 to cover from a front end of an inner surface of the base 103 to a joining portion of the flap 12 and the cover 101; a receiving member 16 made of cardboard and attached to a portion of a top of the sheet of paper 14 directly above the base 103, the receiving member 16 including a receptacle 161 and a groove 162 on a front end of a bottom for allowing a hinged front portion 121 of the flap 12 to insert into; and a through hole 18 through the base 103, the sheet of paper 14, and the receptacle 161.

It is envisaged by the invention that the cosmetic container is completely made of paper without a mirror and magnets. Closing of the cosmetic container (i.e., firmly joining the cover 101 and the remaining parts of the cosmetic container together) is implemented by inserting the hinged front portion 121 of the flap 12 into the groove 162. In short, the cosmetic container is environmentally friendly.

The receptacle 161 may be oval or multisided other than being circular as shown in FIG. 1.

As shown in FIG. 2 specifically, the flap 12 includes a joining portion 123 having one surface attached to the cover 101 and the other surface attached to the sheet of paper 14, the hinged front portion 121 configured to insert into the groove 162, and an intermediate portion 122 hingedly interconnected to the joining portion 123 and the hinged front portion 121

Figure 3:
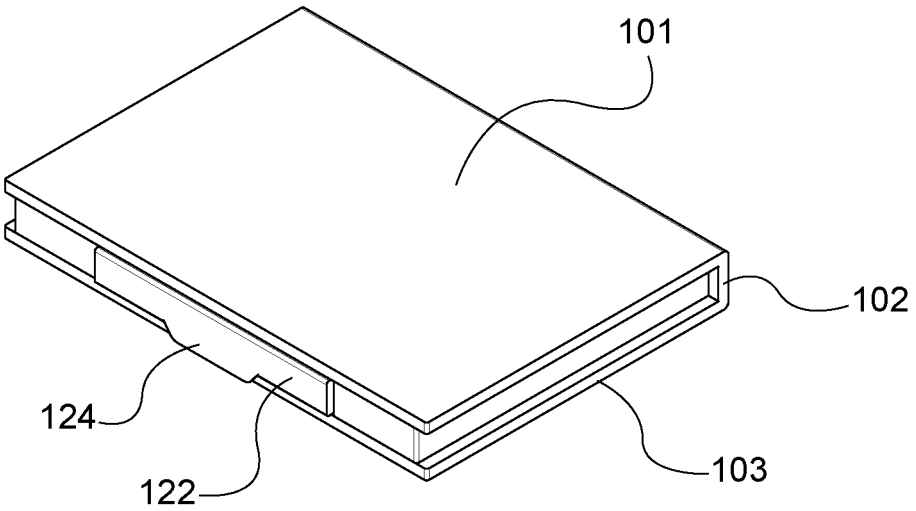
FIG. 3 is a perspective view of the paper container in a closed position.
Figure 4:
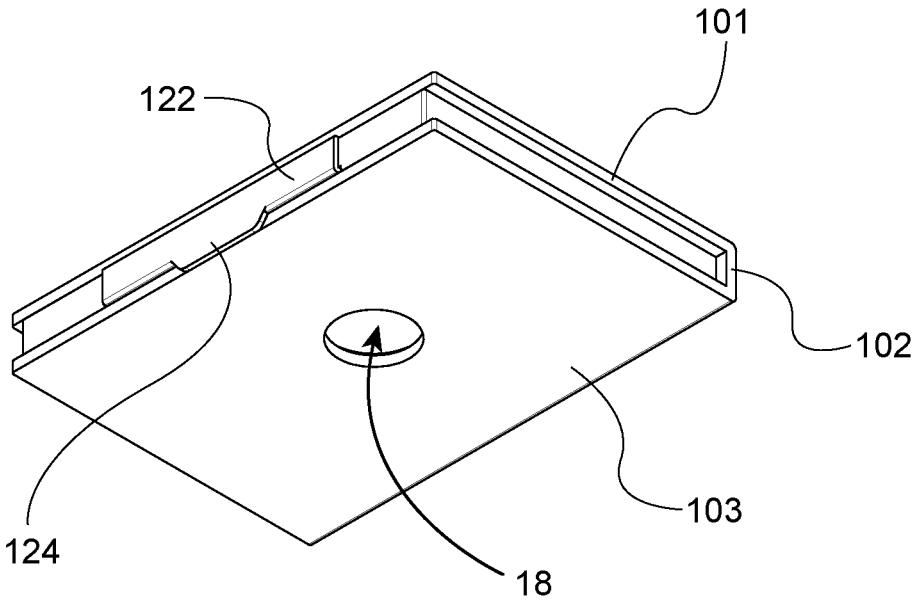
FIG. 4 is another perspective view of FIG. 3, viewed from the bottom.

Referring to FIGS. 3 and 4 in conjunction with FIG. 2, the flap 12 further comprises a hinged tab 124 in an intermediate portion of a joining edge of the hinged front portion 121 and the intermediate portion 122. Therefore, after inserting the hinged front portion 121 into the groove 162, the receiving member 16 is securely closed by the cover 101. An individual can easily open the closed cosmetic container by pulling the hinged tab 124.

Figure 5:
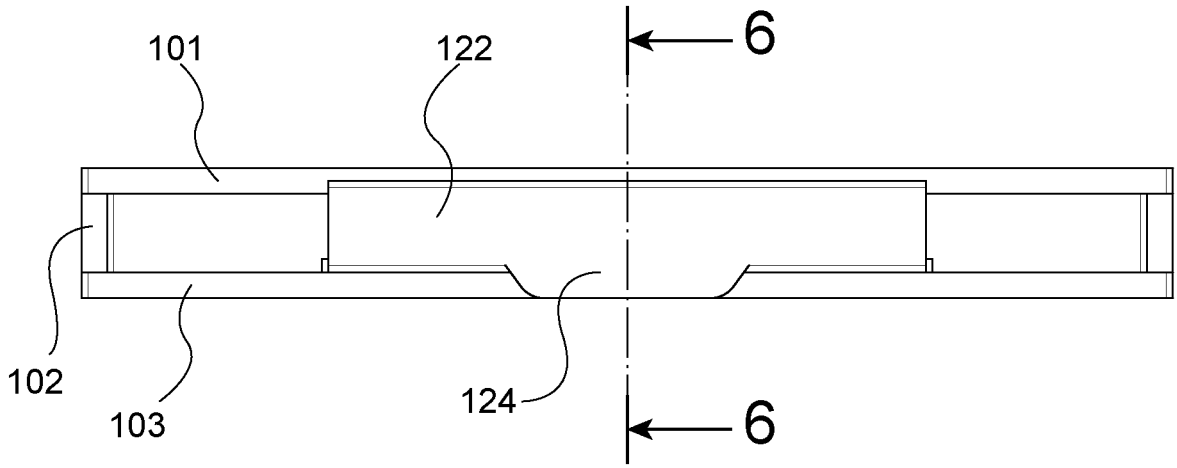
FIG. 5 is a front view of FIG. 3.
Figure 6:
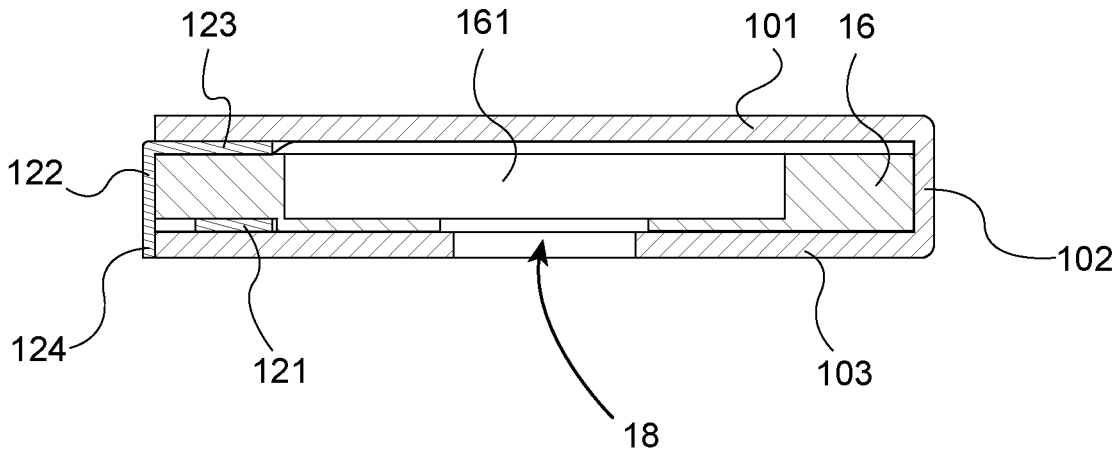
FIG. 6 is a sectional view taken along line 6-6 of FIG. 5.

Referring to FIGS. 5 and 6 in conjunction with FIG. 2, it is clear that the through hole 18 passes through the base 103, the sheet of paper 14 and the receptacle 161. After inserting the hinged front portion 121 into the groove 162, the intermediate portion 122 engages a front end of the receiving member 16 and the hinged tab 124 urges against a top of a front end of the base 103. As a result, the receiving member 16 is securely closed by the cover 101.

Figure 7:
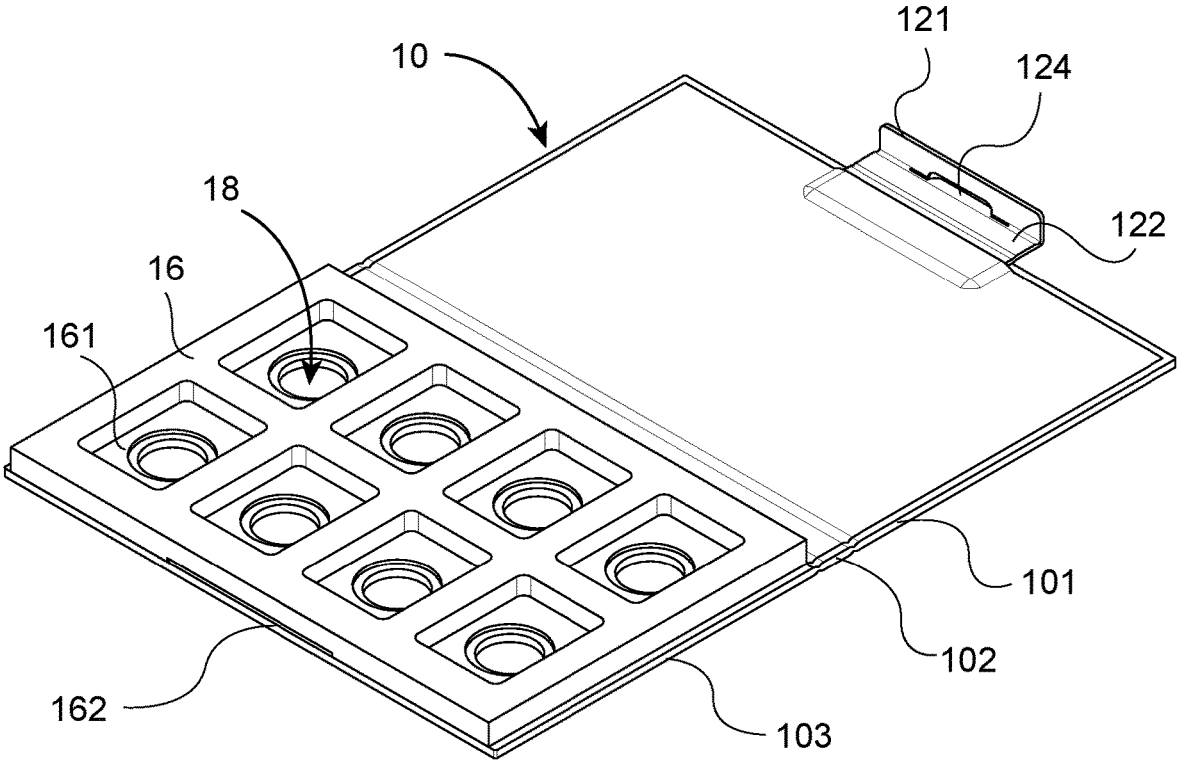
FIG. 7 is a perspective view of a paper container for cosmetic products according to a second preferred embodiment of the invention, the paper container being open.

Referring to FIG. 7, the receiving member 16 is included in a paper container for cosmetic products (hereinafter "cosmetic container") in accordance with a second preferred embodiment of the invention is shown. The characteristics of the second preferred embodiment are substantially the same as that of the first preferred embodiment except the following: the receiving member 16 comprises a plurality of receptacles 161, and a plurality of through holes 18 through the base 103. The receptacles 161 are aligned with and communicate with the through holes 18 respectively.

Figure 8:
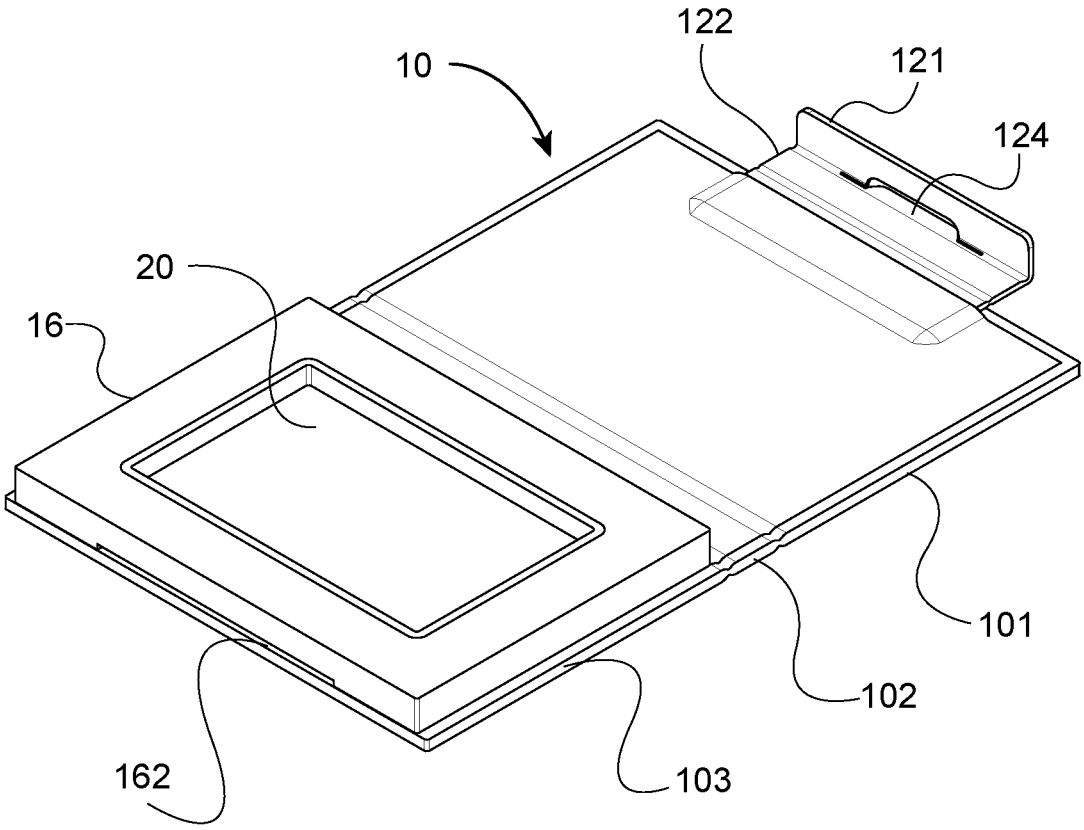
FIG. 8 is a perspective with of the paper container according to the first preferred embodiment of the invention, the paper container being open and a cosmetic box being disposed in the receptacle.

Referring to FIG. 8 in conjunction with FIG. 2, a cosmetic box 20 is releasably disposed in the receptacle 161. The cosmetic box 20 is made of metal or plastic and filled with foundation, cosmetic powder, or blush. An individual may insert his or her finger through the through hole 18 to push the cosmetic box 20 out of the receptacle 161 for use. After use, the individual may place another cosmetic box 20 in the receptacle 161 again. That is, the cosmetic container can be reused. Further, the cosmetic container can be recycled for environmental protection purposes.

While the invention has been described in terms of preferred embodiments, those skilled in the art will recognize that the invention can be practiced with modifications within the spirit and scope of the appended claims.

What is claimed is:

1. A paper container for cosmetic products, comprising:

a casing made of cardboard and including a cover, a base, and an intermediate section hingedly interconnected to the cover and the base;

a flap made of paper, wherein the flap includes a joining portion having a surface attached to an inner surface of the cover, a hinged front portion, and an intermediate portion hingedly interconnected to the joining portion and the hinged front portion;

a receiving member made of cardboard attached to a top of the base, having a back end and a front end opposite to the back end, and including at least one receptacle and a groove on the front end, wherein the hinged front portion of the flap is configured to insert into the groove; and a through hole extending through the base and the at least one receptacle.

2. The paper container of claim 1, further comprising a sheet of paper attached to an inner surface of the casing to cover from a front end of an inner surface of the base to the joining portion of the flap, wherein the through hole extends through the sheet of paper.

3. The paper container of claim 1, wherein the flap further comprises a hinged tab at a joining edge of the hinged front portion and the intermediate portion, and wherein after inserting the hinged front portion into the groove, the hinged tab urges against an outer surface of a front end of the base.

4. The paper container of claim 1, wherein the at least one receptacle is configured to receive a cosmetic box.

5. The paper container of claim 1, wherein the at least one receptacle is one of circular, oval and multisided.

* * * * *